United States Patent [19]

Heronema

[11] 4,230,441

[45] Oct. 28, 1980

[54] OUTSIDE CORNER FINISHING TOOL

[76] Inventor: Joseph D. Heronema, 16309 Bellbrook, Covina, Calif. 91723

[21] Appl. No.: 961,620

[22] Filed: Nov. 17, 1978

[51] Int. Cl.[2] ..... E04F 21/08

[52] U.S. Cl. ..... 425/87; 425/458

[58] Field of Search ..... 425/87, 458, 114, 447

[56] References Cited

U.S. PATENT DOCUMENTS

| | | | |
|---|---|---|---|
| 1,158,460 | 11/1915 | Doll | 425/87 |
| 2,300,398 | 11/1942 | Ames | 425/87 |
| 2,594,606 | 4/1952 | Ames | 425/87 |
| 2,824,442 | 2/1958 | Ames | 425/87 |
| 2,889,965 | 6/1959 | Ames | 425/87 |
| 2,984,857 | 5/1961 | Ames | 425/87 |
| 3,888,611 | 6/1975 | Ames | 425/87 |
| 3,932,101 | 1/1976 | Johnson et al. | 425/458 |
| 4,032,283 | 6/1977 | Johnson et al. | 425/458 |

*Primary Examiner*—Murray Tillman
*Assistant Examiner*—A. H. Koeckert
*Attorney, Agent, or Firm*—Boniard I. Brown

[57] ABSTRACT

A cement applicator for outside corners such as those used in dry wall construction which includes a container for the cement having an open front and a back wall which is moveable along tracks when pressure is applied thereto to force cement out of the front and into the corner. The tool also includes at least two wheels positioned to track along the edge of the corner to be finished and adjacent wipers which are biased to form an angle less than a 90° angle therebetween about the wheels. The wipers include peripheral seals which in combination with the biasing action and the regulation of the tool position by means of the wheels finish the surface of the cement applied to the corner. The wipers may be of different lengths to provide for corners such as those found on stud walls or around windows.

11 Claims, 8 Drawing Figures

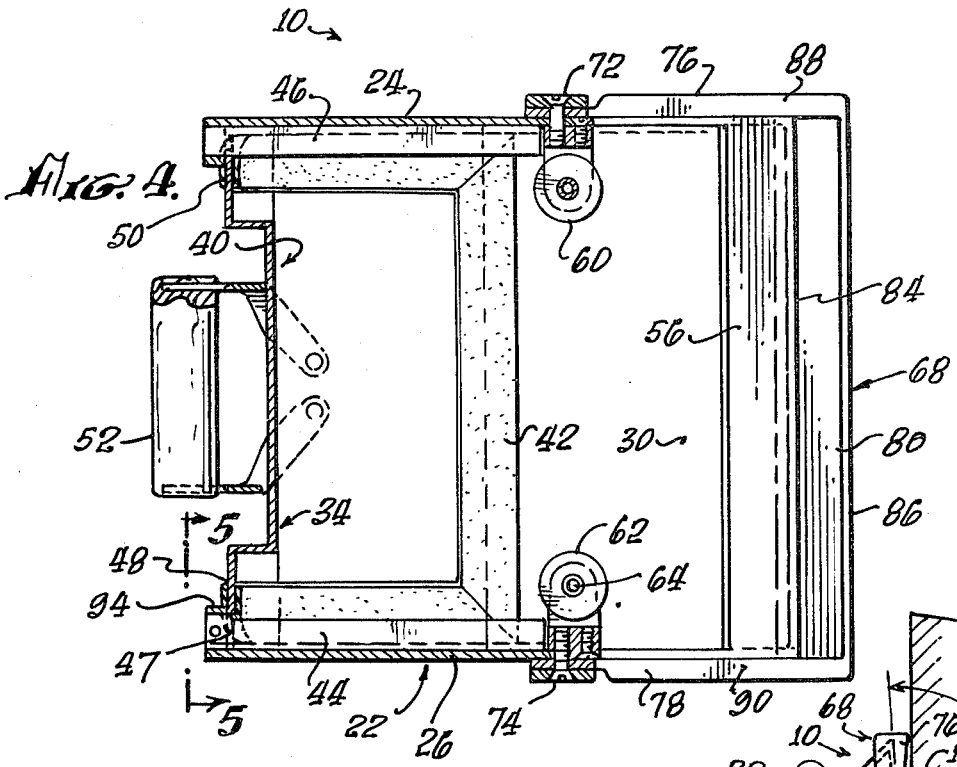
FIG. 4.
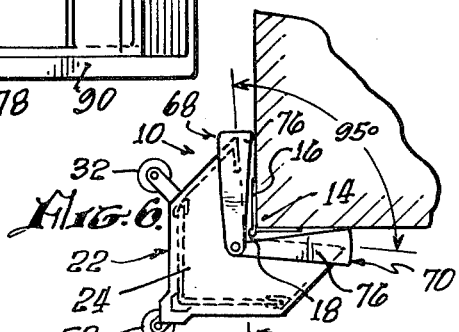
FIG. 6.
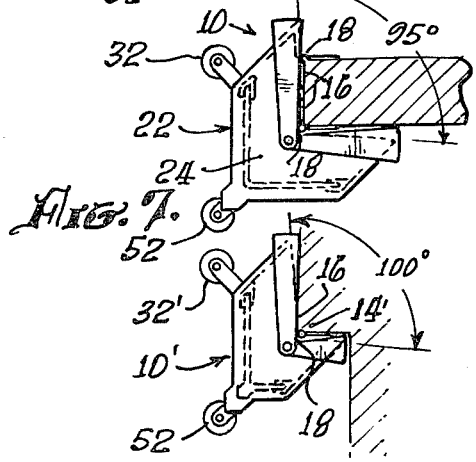
FIG. 7.
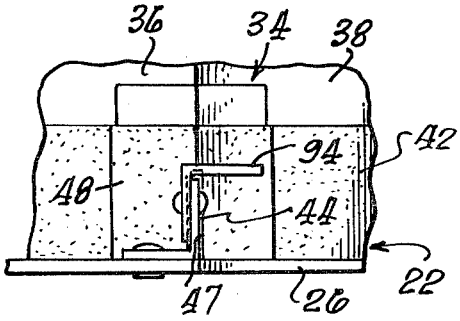
FIG. 5.
FIG. 8.

OUTSIDE CORNER FINISHING TOOL

BACKGROUND OF THE INVENTION

Popular construction includes the use of dry wall or gypsum board sections secured to wall studs at corners and joints along the wall. The corners and joints are smoothed by application of cement or mastic such as with those tools disclosed by R. G. Ames in U.S. Pat. Nos. 2,824,442, 2,984,857 and 3,888,611. The disclosed tools are improvements over the previous method which was manual application of the cement by means of trowels or trowel-like devices. Ames' devices, however, are not adaptable to finish an outside corner, that is one which is formed at an angle of approximately 270°. Therefore, said corners which conventionally include a galvanized perforated beaded member well known in the plastering art, are usually finished by means of manual application of the cement to the corner with a trowel. To finish such an outside corner in a satisfactory manner requires the skill of a plasterer and a substantial amount of hand labor, the elimination of which is a prime reason that dry wall is so popular in residential home construction. Therefore, there has been a need to provide a tool which is relatively easy to operate which can finish an outside corner quickly with relatively little skill being required by the operator and at the same time be relatively economical so that its use is cost effective when compared to hand plastering.

SUMMARY OF THE INVENTION

The present invention is a hand tool constructed to easily finish outside corners even though they may be slightly inaccurate in their 270° angle. The present tool primarily is designed for use when the corner to be finished includes a galvanized, perforated bead member or suitable substitute as are typically used in residential construction. The unit includes a housing which acts as a container for the cement. The front or cement applying side, of the tool is relatively open whereas the back side includes a wall slideable on and guided by suitable tracks which acts like a piston so that the cement within the container can be gradually forced out of the opening in the front thereof and about the bead memeber. Suitable seals are provided about this back wall as is a handle for application of the manual force thereto. The front or opened end of the tool includes at least two rollers or wheels positioned to roll on the corner bead and usually located near the extremities of the tool. The axes of the wheels are oriented to allow movement of the tool in the desired direction along the bead member. When the tool is being used on a vertical corner, the wheels are located vertically and a pair of laterally and forwardly extending wipers biased so they can be spread to an angle about 10° on either side of 90° are provided to contact the wall and wipe the cement so that a smooth cement surface is formed on both sides of the bead to the adjacent walls as the tool is moved down the corner. One or more handles may also be connected to the sides of the container so that lateral pressure can be applied when partial corners are being finished and to allow manual stabilization of the tool as it is moved along the corner.

It is therefore an object of the present invention to provide a tool for the application of cement, mastic or other material to an outside corner during the finishing thereof.

Another object is to reduce the tme and cost of finishing outside corners in building construction especially when dry wall construction is being utilized.

Another object is to provide an outside corner cement applicator/tool which is relatively economical of manufacture, trouble-free, and is easy to use with a minimum of training.

Another object is to increase the speed at which outside corners and dry wall construction can be finished.

These and other objects and advantages of the present invention will become apparent to those skilled in the art after considering the following detailed specification which covers preferred embodiments thereof in conjunction with the accompanying drawings:

BRIEF DESCRIPTION OF THE DRAWINGS

FIG. 4 is a cross-sectional side view showing one side portion of the tool and taken on line 4—4 of FIG 3;

FIG. 5 is an enlarged detailed view of the area shown as 5—5 in FIG. 4;

FIG. 6 is a top view of the present invention applying cement to a full corner;

FIG. 7 is a top view of the tool of FIG. 6 applying cement to a stud wall; and FIG. 8 is a modified version of the tool having one side of reduced size for application of cement to corners such as those found around windows.

DETAILED DESCRIPTION OF THE PRESENT EMBODIMENT

Figure 1:
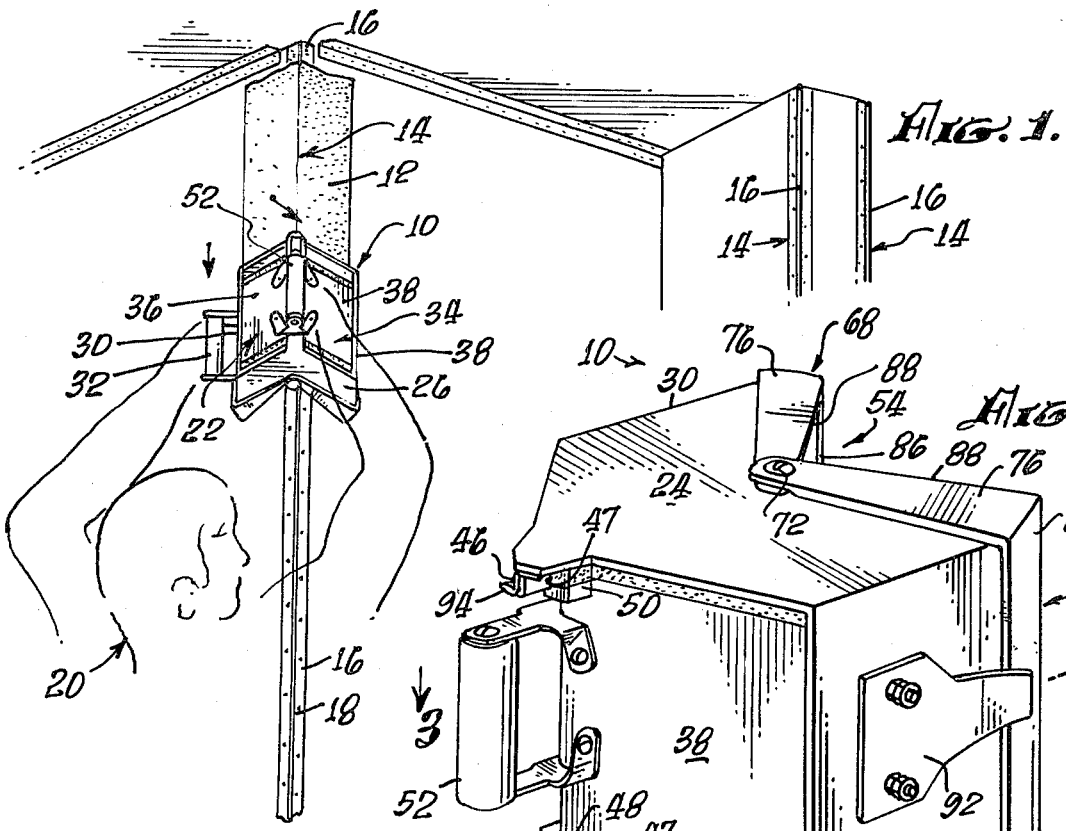
FIG. 1 is the fragmentary perspective view showing how a drywall corner is finished with cement using the tool of the present invention.

Referring to the drawings more particularly by reference numbers, number 10 in FIG. 1 refers to an outside corner finishing tool constructed according to the present invention. The tool 10 is used to apply cement, mastic or the like 12, sometimes referrred to as mud, along an outside corner 14 which may be the vertically oriented corner as shown or oriented at any other angle. The corner 14 usually includes a perforated bead strip 16 nailed or otherwise attached to the corner 14 so that its outstanding bead 18 provides a wear surface for the corner 14. The operator 20 is shown applying the cement 12 by suitable motion of the tool 10 and through application of manual force thereagainst as will be explained. The tool 10 will be described as it is oriented along the wall in FIG. 1 although its actual orientation and use depends upon the directon of orientation of the corner, the length of the adjacent walls and the preference of the operator 20.

Figure 2:
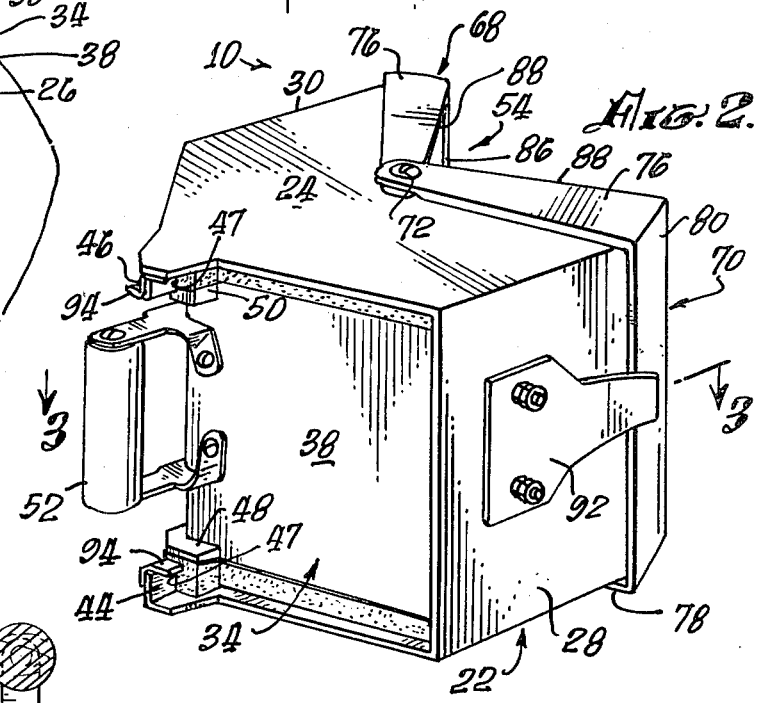
FIG. 2 is a perspective view of the tool constructed according to the present invention.
Figure 3:
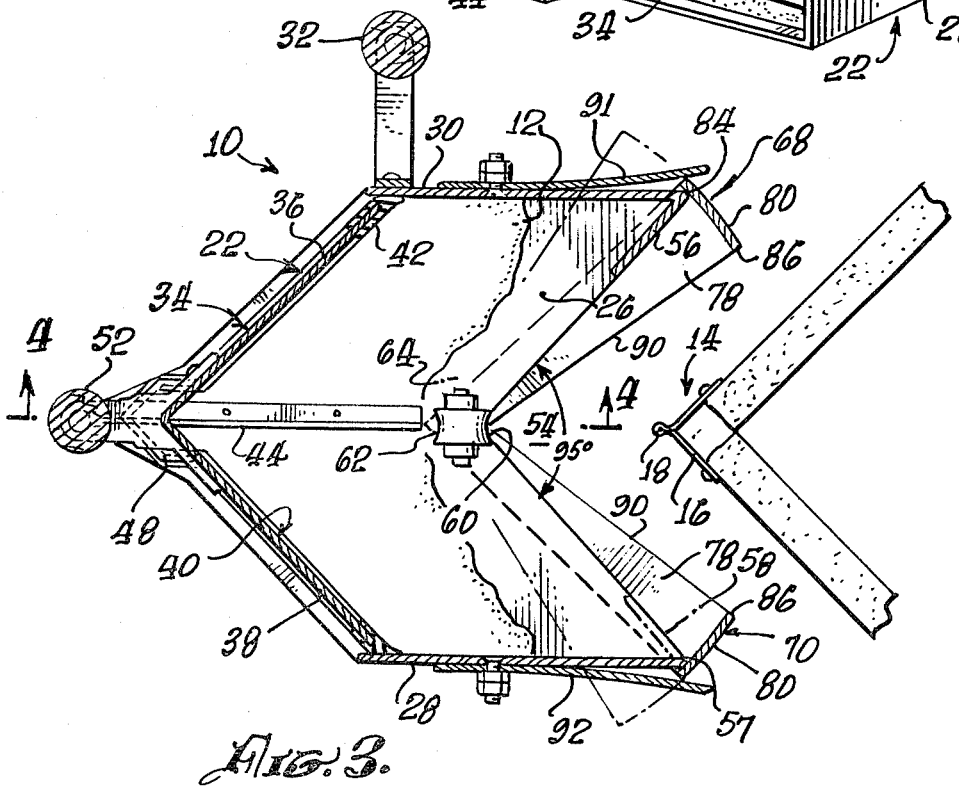
FIG. 3 is a cross-sectional top view taken on line 3—3 of FIG. 2.

As shown in FIG. 2, the tool 10 includes a housing 22 having connected and relatively stiff, top 24, bottom 26 and side walls 28 and 30. A handle 32 is connected to one of the sides 30 for use in stabilizing the tool 10 in its path along the corner 16 and to apply lateral pressure when such is desired as will be explained hereinafter. The housing 22 also includes a movable back wall 34 which has two portions 36 and 38 which are formed at approximately a right angle to each other. The back wall 34 along with the walls 24, 26, 28 and 30 form a container area 40 (FIG. 3) which is filled with cement 12 prior to use of the tool 10 to apply the cement to the corner 16. The back wall 34 includes a seal 42 about its periphery which engages the walls 24, 26, 28 and 30 to prevent leakage of the cement therebetween. The back wall 34 is mounted on opposed tracks 44 and 46 by means of slots 47 in slide blocks 48 and 50 connected thereto so that application of manual force by means of a handle 52 also connected thereto can force the back wall 34 toward the front portion 54 of the tool 10 to force the back wall 34 toward the front portion 54 of the tool 10 to force the cement in the volume 40 into contact with the corner 14.

The front portion 54 of the housing 22 includes an opening defined by a retainer member 56 on one side and the front edge 57 of the side wall 22 or by an optional second retainer member 58. The retainer members 56 and 58 extend vertically between the top and bottom walls 24 and 26 and at about 40° to the side walls 28 and 30 so that about a 95° angle is defined therebetween. The retainer members 56 and 58 assure that cement 12 forced out of the front portion 54 of the tool 10 by the application of manual force to the handle 52 is first applied about the bead 18. In some applications when the retainer 58 is not required, the retainer 56 is used to counteract force applied by means of the side handle 32. The tool 10 is spaced from the bead 18 by at least two wheels 60 and 62 (FIG. 4) which mounted to the housing 22 so that their rolling axes 64 are at right angles to the orientation of the corner when the tool 10 is in use. The wheels 60 and 62 preferably have concave surfaces 66 so that they easily track along the bead 18 to maintain the proper spacing of the tool 10 from the bead 18.

A pair of wiper elements 68 and 70 are provided adjacent the front portion 54. The wiper elements 68 and 70 are pivoted to the housing 22 by suitable hinges 72 and 74 whose common axis is oriented parallel to the bead 18 when the tool 10 is in position for use and at a right angles to the axes 64 of the wheels 60 and 62. The wiper elements 68 or 70 each include relatively flat upper and lower wiper portions 76 and 78 which slide over the upper and lower walls 24 and 26 of the housing 22, respectively, to form a loose seal therewith. The side portions 80 of the elements 68 and 70 are curved so that they can form rough seals with the front edges 57 and 84 of the sidewalls 28 and 30 as the elements 68 and 70 rotate about the hinges 72 and 74.

The wiper elements 68 and 70 are hinged so that they can follow the corner 14 which although is usually approximately 90° may vary considerably from wall to wall. This is accomplished by providing a wall contact surface 86 on each of the forward edges of the side portions 80 of the elements 68 and 70 so that when the tool 10 is pressed against the corner 14 it contacts the bead by means of the wheels 60 and 62 and the adjacent walls by the edges 86. The top and bottom portions 76 and 78 also include wiper surfaces 88 and 90 which cause the surface of the applied cement 12 to be smooth as the tool 10 is moved along the corner as shown in FIG. 1. Bias means such as springs 91 and 92 are connected to the housing 22 in position to bias the wiper elements 68 and 70 together so that the angle therebetween initially is less than 90°. When the tool 10 is applied to the corner 14, the wiper elements 68 and 70 recoil back to the proper angle to assure contact between the wheels 60 and 62 with the bead 18 and the edges 82 and 84 with the walls adjacent the corner 14. This allows accommodation of corners that are other than 90°.

When in use, the tool 10 is normally started at one end of the corner 14 and then is moved completely along the corner 14 until the other end thereof is reached at which point the direction of the tool 10 is reversed and through application of a slight amount of twisting applied to the handles 52 and 32, the tool 10 is rotated slightly away from the corner so that its trailing edge and wheel remain in contact as the upper wheel is lifted. During this period, the force applied to the handle 52 is diminished so that somewhere centrally along the corner 14, a fine feathered edge is accomplished and the tool 10 can be removed from the corner 14.

Once the cement 12 within the volume 40 has been used up, the back wall is returned to its backwardmost position by means of manual force applied to the handle 52. The back location of the back wall 34 is fixed by means of stops 94 connected to block the tracks 44 and 46 and positioned to contact the sliding blocks 48 and 50. The stops 94 may be merely a piece of track riveted across the track as shown in detail in FIG. 5 with respect to track 44.

In FIG. 6 it can be seen how the tool 10 is used to apply cement 12 to a full corner. It also should be noted that the angle of the front portion is approximately 95° so that the wiper elements 68 and 70 can accommodate corner angles from 95° to lesser included angles as determined by their width. When the tool 10 is being used as shown in FIG. 6 force is applied primarily to handle 52 with handle 32 being used only for stabilization purposes.

FIG. 7 shows the tool 10 being used to finish a corner in a stub wall, that is one having a relatively short wall adjacent the corner. In this case, substantial force is applied by means of handle 32 so that the retainer member 56 contacts the wall which is too short for contact by the edge 86.

FIG. 8 shows a slightly modified verson 10' of the present invention wherein one side thereof has been shortened so that outside corners closely adjacent a window or other obstruction can be accommodated. In such as embodiment, the angle of the front is increased since it is normal for such corners 14' to be slightly larger than 90°.

Thus, there has been shown and described a novel tool for applying cement for smoothing an outside corner in dry wall or similar construction which fulfills all of the objects and advantages sought therefore. Many changes, alterations, variations, and other uses and applications of the subject invention will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

The inventor claims:

1. A tool for simultaneously finishing first and second walls adjacent the edge of an outside corner with plastering material, the tool including:

a housing having perpherial walls constituting first and second side portions corresponding to the first and second walls, a back piston and a front which is at least partially open to form a container for the plastering material;

means for applying force to said back piston to move said back piston toward said front so that the plastering material can be forced toward said front and simultaneously applied to the first and second walls about the corner;

at least two guide means adapted to track along the edge of the corner connected to said housing in position to engage the edge of the corner when plastering material is being applied thereto;

a first wiper member connected to said housing about said first side portion adjacent said front thereof in position to smooth and finish the plastering material as the material is applied to the first wall adjacent the corner and as said tool is moved therealong; and a second wiper member connected to said housing about said second side portion adjacent said front thereof in position to smooth and finish the plastering material as the material is applied to the second wall adjacent the corner and as said tool is moved therealong.

2. The tool defined in claim 1 including pivots positioned to hingedly connect both said first and second wiper members to said housing along an axis which is parallel to the corner edge when said tool is in use.

3. The tool defined in claim 2 wherein said first and second wiper members have inside surfaces shaped to form at least loose seals with said housing as said first and second wiper members rotate about said pivots.

4. The tool defined in claim 3 wherein said first and second wiper members are U shaped, said U shaped wiper members each having central abutment edges for contact with the walls a distance spaced from the corner and first and second opposite side edges for smoothing the plastering material applied to the corner, said second edges being positioned to form about a right angle therebetween.

5. The tool defined in claim 4 including bias means connected to said housing in position to bias said first and second wiper members so that said second opposite side edges of said wiper members have less than a 90° angle therebetween when said central abutment edges are not in contact with a wall.

6. The tool defined in claim 5 wherein said guide means include at least two wheels positioned to contact the corner edge, said housing including at least one retainer member (56) which extends across a portion of said front adjacent a wall of said housing which is generally parallel to the axis of said pivots, said retainer member including an abutment surface for engagement with a wall adjacent the corner to limit the rotation of said tool about said wheels in the direction toward said retainer member.

7. The tool defined in claim 6 wherein said housing includes a handle positioned thereon so that manual force applied thereto can be transfered to said abutment surface.

8. The tool defined in claim 7 wherein said housing includes tracks oriented toward said front connected thereto, said back piston including slider blocks connected thereto with slots adapted to slide on said tracks so that the motion of said back piston is restricted to movement along said tracks.

9. The tool defined in claim 8 wherein at least one of said tracks includes a stop therealong positioned to restrict motion of said piston away from said front to a predetermined distance.

10. The tool defined in claim 9 wherein said first and second opposite side edges of said first wiper member are shorter than said first and second opposite side edges of said second wiper member.

11. The tool defined in claim 5 wherein said wheels each include a concave corner edge engaging surface.

* * * * *